US007153173B2

(12) United States Patent
Harasawa et al.

(10) Patent No.: US 7,153,173 B2
(45) Date of Patent: Dec. 26, 2006

(54) ELECTRIC CONNECTOR

(75) Inventors: Masaaki Harasawa, Yokohama (JP); Saburou Kase, Tokyo (JP); Satoru Kihara, Kawasaki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 5 days.

(21) Appl. No.: 10/445,182

(22) Filed: May 23, 2003

(65) Prior Publication Data

US 2003/0211787 A1 Nov. 13, 2003

Related U.S. Application Data

(63) Continuation of application No. 10/017,987, filed on Dec. 13, 2001, now abandoned.

(30) Foreign Application Priority Data

Dec. 18, 2000 (JP) ..... 2000-384530

(51) Int. Cl.
*H01R 4/48* (2006.01)

(52) U.S. Cl. ..... 439/862

(58) Field of Classification Search ..... 439/862, 439/752, 595, 701, 596, 598, 344, 660, 329, 439/55, 188

See application file for complete search history.

(56) References Cited

U.S. PATENT DOCUMENTS

| | | | | |
|---|---|---|---|---|
| 3,680,035 | A | | 7/1972 | Teagno et al. |
| 3,742,430 | A | | 6/1973 | Cairns et al. |
| 4,087,151 | A | * | 5/1978 | Robert et al. ..... 439/188 |
| 4,209,217 | A | | 6/1980 | Gudaitis et al. |
| 4,295,009 | A | | 10/1981 | Weidler |

(Continued)

FOREIGN PATENT DOCUMENTS

| | | |
|---|---|---|
| CN | 1177675 | 4/1998 |
| DE | 196 11 422 | 9/1997 |
| EP | 0 822 616 | 2/1998 |
| FR | 2497007 | 6/1982 |
| FR | 2 566 589 | 12/1985 |
| JP | 53-163582 | 5/1952 |
| JP | 55-9019 | 1/1980 |
| JP | 57-12671 | 8/1982 |
| JP | 58-44775 | 3/1983 |
| JP | 62-12281 | 1/1987 |

(Continued)

OTHER PUBLICATIONS

"Electric Connector" by Masaaki Harasawa et al.; U.S. Appl. No. 10/017,98.; filed Dec. 13, 2001, pp. 1 to 25 and 15 sheets of drawings.

"Electric Connector" by Masaaki Harasawa et al.; U.S. Appl. No. 10/017,977, filed Dec. 13, 2001, pp. 1 to 27 and 18 sheets of drawings.

*Primary Examiner*—Ross Gushi
(74) *Attorney, Agent, or Firm*—W. F. Fasse; W. G. Fasse

(57) ABSTRACT

An electric connector is connected to a conductive part, e.g. an electric wire, of a first article, and is fitted onto the first article and/or a second article. The contact of the electric connector directly contacts a conductive part of the second article with a sufficient contact pressure. The electric connector includes a housing fitted onto at least one of the articles, and a contact provided on the housing and including a connecting part connected to the conductive part of the first article, a contacting point contacting the conductive part of the second article, and an elastic part, which undergoes elastic deformation when the contacting point is pressed. The housing and/or the contact has a holding member, which holds the elastic part in an elastically deformed condition in advance in the direction of pressing the contacting point and prevents the restoring movement thereof.

34 Claims, 17 Drawing Sheets

U.S. PATENT DOCUMENTS

| | | | | | |
|---|---|---|---|---|---|
| 4,558,270 | A | * | 12/1985 | Liautaud et al. | 320/110 |
| 4,778,407 | A | | 10/1988 | Myers | |
| 5,051,100 | A | | 9/1991 | Kato et al. | |
| 5,090,925 | A | * | 2/1992 | Sato et al. | 439/862 |
| 5,231,659 | A | | 7/1993 | Abraham et al. | |
| 5,232,373 | A | | 8/1993 | Sawada | |
| 5,271,740 | A | * | 12/1993 | Endo et al. | 439/637 |
| 5,308,265 | A | | 5/1994 | Kaneko | |
| 5,456,617 | A | | 10/1995 | Chishima et al. | |
| 5,458,502 | A | * | 10/1995 | Joly | 439/397 |
| 5,484,295 | A | | 1/1996 | Mowry et al. | |
| 5,605,150 | A | * | 2/1997 | Radons et al. | 600/300 |
| 5,647,778 | A | | 7/1997 | Yamaguchi et al. | |
| 5,676,562 | A | | 10/1997 | Fukuda | |
| 5,718,597 | A | | 2/1998 | Kodama | |
| 5,746,607 | A | | 5/1998 | Bricaud et al. | |
| 5,891,591 | A | * | 4/1999 | Suzuki | 429/178 |
| 5,897,402 | A | | 4/1999 | Sasai et al. | |
| 5,947,775 | A | | 9/1999 | Yamamoto et al. | |
| 5,975,914 | A | | 11/1999 | Uchida | |
| 5,980,322 | A | | 11/1999 | Madsen et al. | |
| 6,022,224 | A | | 2/2000 | Peters | |
| 6,095,831 | A | | 8/2000 | Muramatsu et al. | |
| 6,095,855 | A | * | 8/2000 | Iwata et al. | 439/553 |
| 6,099,356 | A | | 8/2000 | Hwang | |
| 6,102,722 | A | | 8/2000 | Arnett | |
| 6,126,458 | A | * | 10/2000 | Gregory et al. | 439/76.2 |
| 6,126,496 | A | | 10/2000 | Shinozaki | |
| 6,135,828 | A | | 10/2000 | Lalange et al. | |
| 6,217,396 | B1 | | 4/2001 | Hwang et al. | |
| 6,280,262 | B1 | | 8/2001 | Tanaka | |
| 6,309,262 | B1 | | 10/2001 | Morris | |
| 6,315,621 | B1 | | 11/2001 | Natori et al. | |
| 6,343,960 | B1 | | 2/2002 | Sato | |
| 6,589,082 | B1 | | 7/2003 | Harasawa et al. | |
| 2002/0048975 | A1 | | 4/2002 | Horikoshi et al. | |
| 2002/0076994 | A1 | | 6/2002 | Harasawa et al. | |

FOREIGN PATENT DOCUMENTS

| | | |
|---|---|---|
| JP | 1-142167 | 9/1989 |
| JP | 1-168970 | 11/1989 |
| JP | 4-72488 | 6/1992 |
| JP | 4-135176 | 12/1992 |
| JP | 6-7177 | 1/1994 |
| JP | 6-29064 | 4/1994 |
| JP | 6-31094 | 4/1994 |
| JP | 06-215833 | 8/1994 |
| JP | 08-022871 | 1/1996 |
| JP | 9-073951 | 3/1997 |
| JP | 09-237650 | 9/1997 |
| JP | 09306576 | 11/1997 |
| JP | 10-255931 | 9/1998 |
| JP | 10-340750 | 12/1998 |
| JP | 11-144801 | 5/1999 |
| JP | 2000-150087 | 5/2000 |
| JP | 2001307799 | 11/2001 |
| JP | 2002184489 | 6/2002 |

* cited by examiner

ELECTRIC CONNECTOR

CROSS-REFERENCE TO RELATED APPLICATIONS

This application is a continuation of U.S. application Ser. No. 10/017,987, filed Dec. 13, 2001, now abandoned and is related to U.S. application Ser. No. 10/017,983, and U.S. application Ser. No. 10/017,977, both filed on Dec. 13, 2001.

BACKGROUND OF THE INVENTION

1. Field of the Invention

The present invention belongs to a field of electric connectors, which are used to electrically connect two articles that are exemplified by printed circuit board, electrical part, etc.

2. Related Art

Electric connectors for electrically connecting two articles include, for example, a pair of a male type crimp connector and a female type crimp connector to be coupled together, which are used extensively. The connecting form of them is, for example, that an electric wire led out of a first article is crimp-connected to a male type crimp connector, an electric wire led out of a second article is crimp-connected to a female type crimp connector, and the male type crimp connector and the female type crimp connector are coupled together to make an electrical connection.

As for the connecting structures using such electric connectors, it is keenly desired to reduce costs and compactify the connectors themselves and related objects.

SUMMARY OF THE INVENTION

The present inventors contemplated reducing the number of electric connectors to be used in a connecting structure to a single one, by fitting an electric connector, which is connected to an electric wire or the like being a conductive part of a first article by crimping or insulation displacement connection, onto the first article and/or a second article and making a contact of the electric connector directly contact a conductive part of the second article, and in turn, to reduce the costs of the connecting structure and compactify it. In that case, if, for example, the relative positional relationship between the electric connector and the article onto which the electric connector is fitted or the relative positional relationship between the articles is off the set points, such troubles may happen that the contact pressure between the contact of the electric connector and the conductive part of the second article is not sufficient and the two articles cannot be connected with each other reliably. One objective of the present invention is to make a reliable electric connection between articles with that electric connector by increasing the contact pressure between the contact and the conductive part of the second article or increasing points of contact between them.

To accomplish the above-mentioned objective, the present invention is an electric connector that is used to electrically connect two articles, each of which having a conductive part. This electric connector comprises a housing, which is fitted onto at least one of the articles, and a contact provided on the housing, and the contact comprises a connecting part, which is connected to a conductive part of a first article, a contacting point, which contacts a conductive part of a second article, and an elastic part, which undergoes elastic deformation when the contacting point is pressed, and at least either the housing or the contact is provided with a holding member, which holds the elastic part in an elastically deformed condition in advance in the direction of pressing the contacting point and prevents the restoring thereof.

When the connecting part of the contact of this electric connector is connected to a conductive part of the first article, the housing is fitted onto the first article, and the two articles are arranged in a specified positional relationship and joined together, the contacting point will contact the conductive part of the second article with a pressing force due to the restoring force of the elastic part and the conductive parts of both the articles will be electrically connected to each other via the contact. Or when the connecting part of the contact of the electric connector is connected to the conductive part of the first article and the housing is fitted onto the second article, the contacting point will contact the conductive part of the second article with a pressing force due to the restoring force of the elastic part, and the conductive parts of both the articles will be electrically connected to each other via the contact. Or when the connecting part of the contact of this electric connector is connected to the conductive part of the first article and the housing is fitted onto both the first article and the second article, the contacting point will contact the conductive part of the second article with a pressing force due to the restoring force of the elastic part, and the conductive parts of both the articles will be electrically connected to each other via the contact.

In any of the above-mentioned connecting forms, as the number of electric connector to be used by this connecting structure is one in contrast with the conventional connecting structure using a pair of a male crimp connector and a female crimp connector, the costs are lowered through the reduction in the number of electric connector in use. As the work of connecting the conductive part to the electric connector, which is exemplified by crimping, can be done by a single operation, the costs are lowered through the improved workability. When the housing is fitted onto both the first article and the second article, as the two articles will be joined together via the electric connector, a separate joining means such as a screw is not needed to join the two articles together, and the costs are reduced through the elimination of any joining means. As a single electric connector is used in the connecting structure, the space occupied by the electric connector is reduced in comparison with the conventional connecting structure wherein a pair of a male crimp connector and a female crimp connector are used, and the connecting structure is compactified.

In this case, as the elastic part is elastically deformed in advance by the holding member in the direction of pressing the contacting point and held to prevent its restoration, a restoring force is accumulated. Accordingly, when the contacting point contacts the conductive part of the second article, a contact pressure corresponding to the above-mentioned restoring force is generated upon the initial contacting. When the elastic part is pressed further against the conductive part of the second article, the contact pressure will increase. With this arrangement, even if, for example, the relative positional relationship between the electric connector and the article onto which the electric connector is fitted or the relative positional relationship between the articles is off the set points and the amount of elastic deformation of the elastic part is reduced, a high contact pressure will be obtained upon the initial contact and a reliable electric connection will be made between the articles.

Accordingly, the electric connector of the present invention achieves significant cost reduction and compactification of the connecting structure through reduction in the number of electric connector in use and improved workability. When the housing is fitted onto both the first article and the second article, the costs can be reduced through elimination of a joining means. Even if, for example, the relative positional relationship between the electric connector and the article onto which the electric connector is fitted or the relative positional relationship between the articles is off the set points and the amount of elastic deformation of the elastic part is reduced, a high contact pressure will be obtained upon the initial contact. Hence a reliable electric connection will be made between the articles by the secured contact pressure at the contacting point.

BRIEF DESCRIPTION OF THE DRAWINGS

FIG. 4A is a plan view, FIG. 4B is a front view, and FIG. 4C is a bottom view.

FIG. 6A shows the contact before it contacts the second article, and FIG. 6B shows the contact after it contacts the second article.

DESCRIPTION OF PREFERRED EMBODIMENTS OF THE INVENTION

Figure 1:
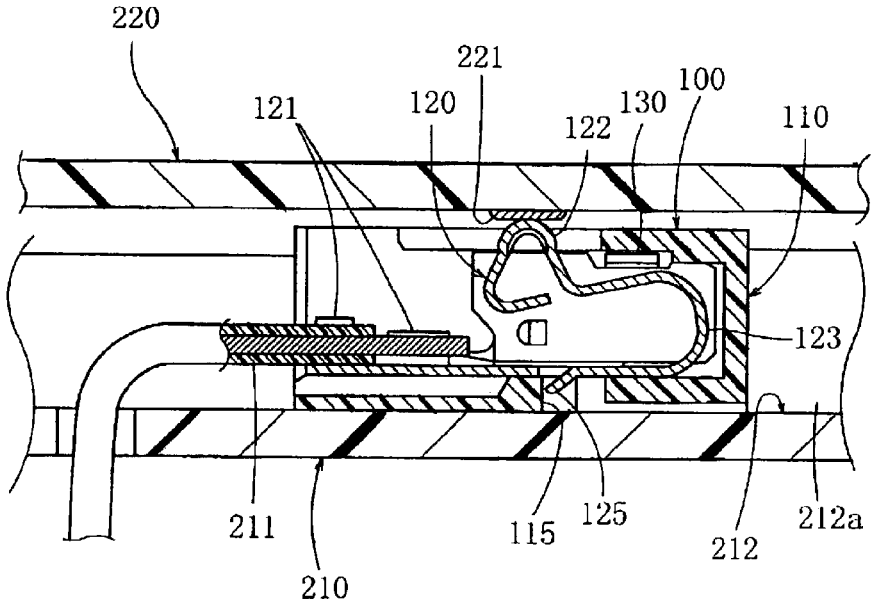
FIG. 1 is a sectional view of the electric connector of the first embodiment when it is used by fitting it onto the first article.
Figure 2:
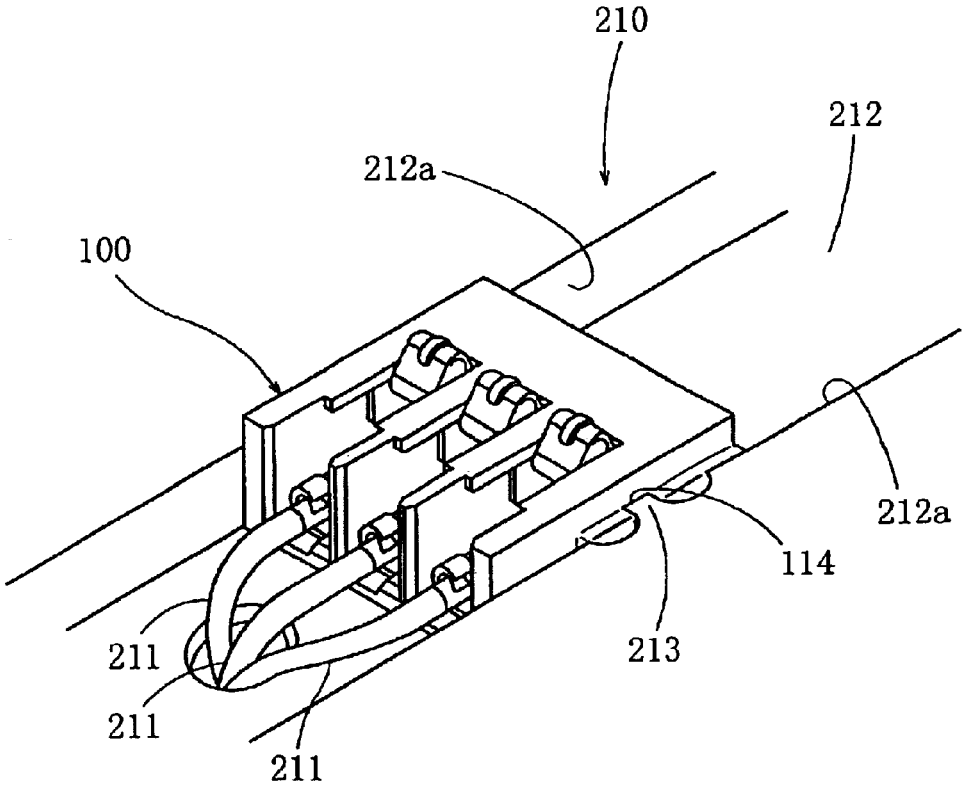
FIG. 2 is a perspective view of the electric connector of the first embodiment when it is used by fitting it onto the first article.
Figure 3:
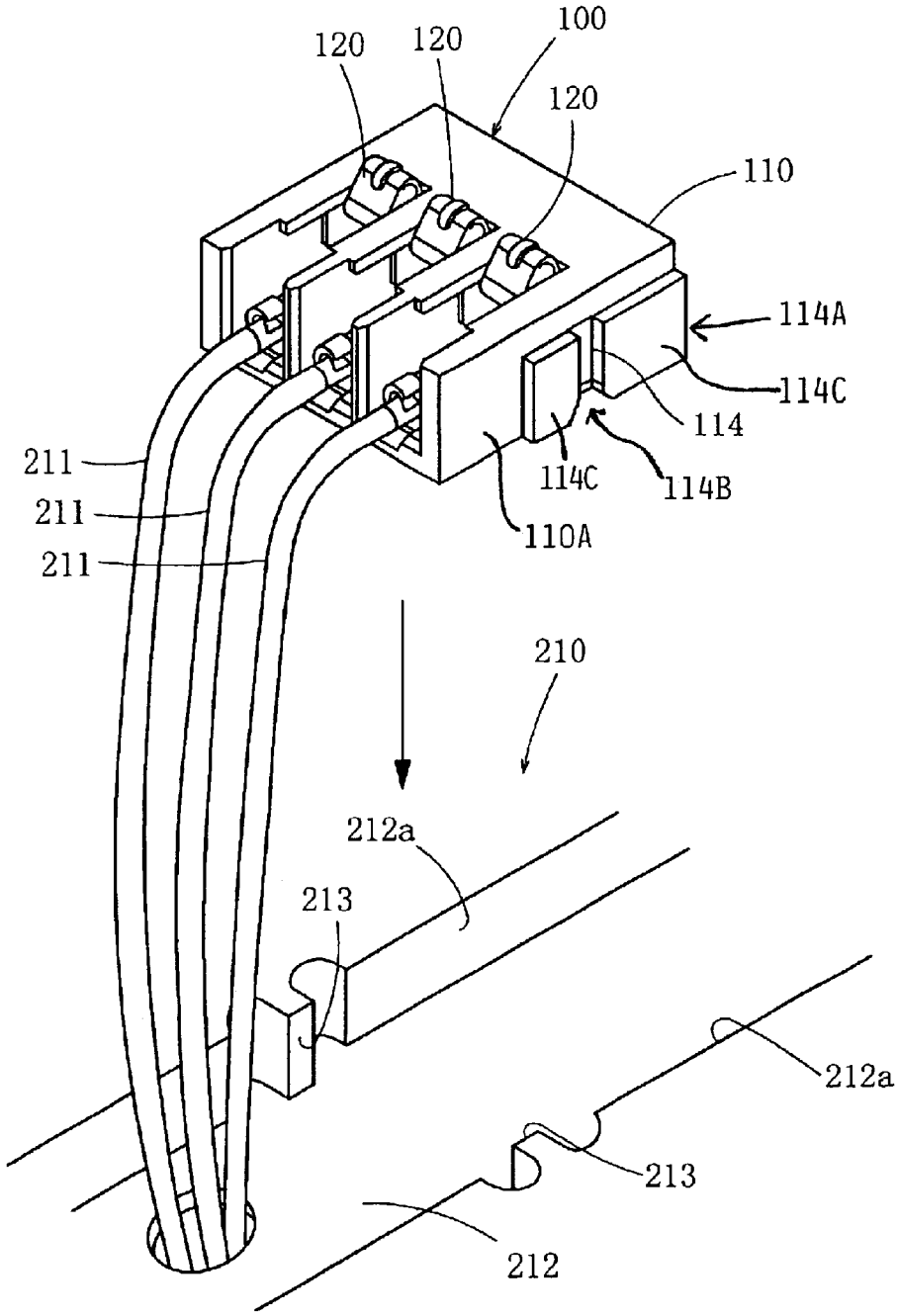
FIG. 3 is a perspective view of the electric connector of the first embodiment when it is fitted onto the first article.

Some embodiments of the electric connector of the present invention will be described below. FIG. 1 through FIG. 3 show the electric connector 100 of the first embodiment. This electric connector 100 is used to electrically connect two articles together, each of which has a conductive part. The electric connector 100 comprises a housing 110, which is fitted onto at least either one of the articles, and a contact 120, which is provided on the housing 110. Here, the first article 210 is exemplified by a casing of an electric appliance, and the conductive part 211 of the first article 210 is exemplified by an electric wire. The second article 220 is exemplified by a printed circuit board, and the conductive part 221 of the second article 220 is exemplified by a conductive pad. The concepts of the articles and the concepts of the conductive parts according to the present invention are not limited in any way by these exemplifications. The articles may be any corporeal things, and the conductive parts may be any members having electric conductivity.

Figure 4A:
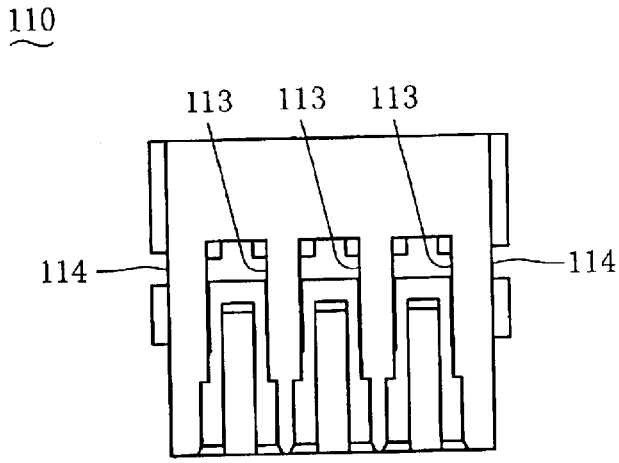
FIG. 4A, FIG. 4B and FIG. 4C show the housing of the electric connector of the first embodiment.
Figure 4B:
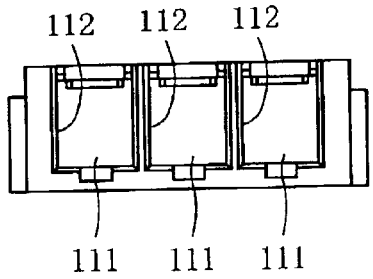
Figure 4C:
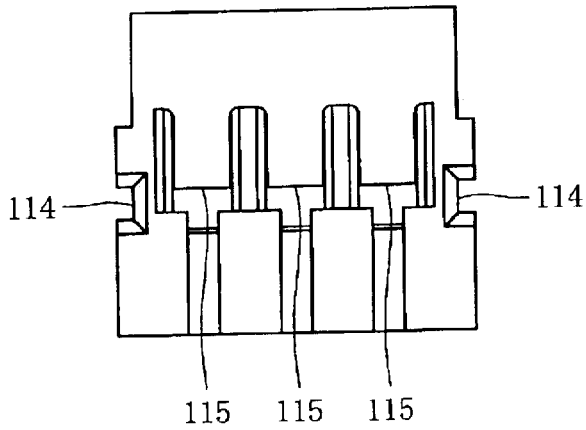

As shown in FIG. 4A, FIG. 4B and FIG. 4C, the housing 110 is formed approximately into a rectangular parallelepiped. For convenience, a direction along one side of the housing 110 is defined as the longitudinal direction, a direction that is approximately perpendicular to that direction is defined as the width direction, and a direction that is approximately perpendicular to both the longitudinal direction and the width direction is defined as the height direction. Inside the housing 110, cavities 111 being cells for storing contacts 120 are formed in the longitudinal direction. The cavities 111 as many as the contacts 120 are formed in a row in the width direction. One end, in the longitudinal direction, of each cavity 111 is opened as an insertion port 112 in one face, in the longitudinal direction, of the housing 110. Each contact 120 is to be inserted through this insertion port 112. A contact window 113 is opened through to each cavity 111 in one face, in the height direction, of the housing 110. A contacting point 122 of the contact 120, which will be described later, is exposed through this contact window 113 to come out of the face of the housing 110. This contact window 113 is formed through to the above-mentioned insertion port 112 so that the contact 120 can be easily inserted into the cavity 111. The housing according to the present invention is not limited to the form of the approximate rectangular parallelepiped. It may be any form, which can be fitted onto the articles and into which the contacts can be assembled.

Figure 5:
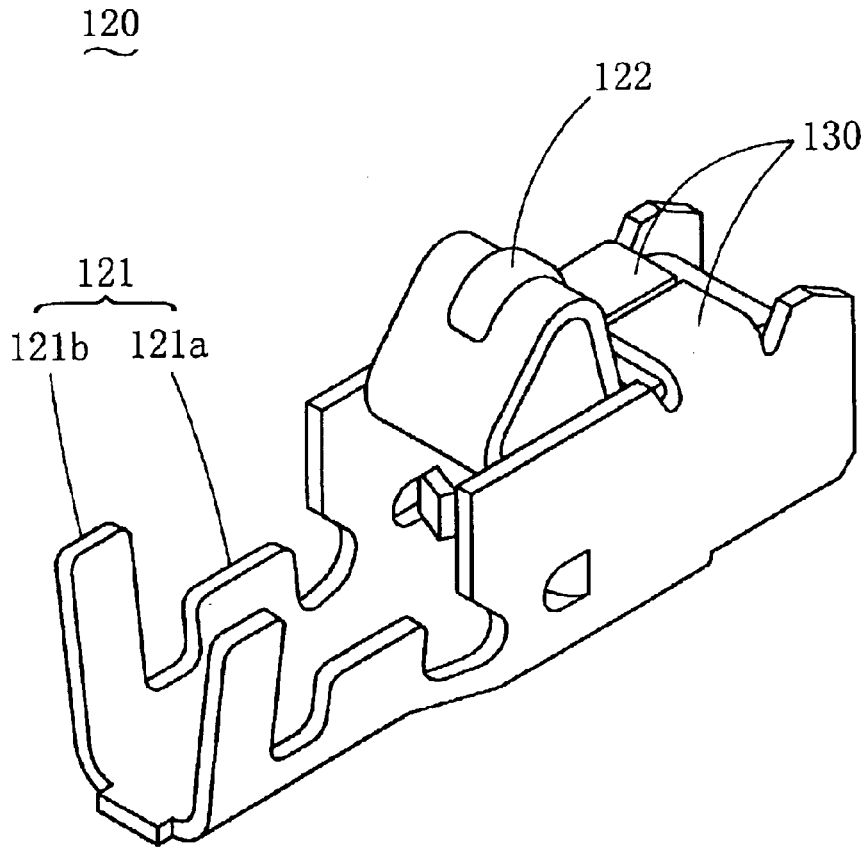
FIG. 5 is a perspective view of the contact of the electric connector of the first embodiment.
Figure 6A:
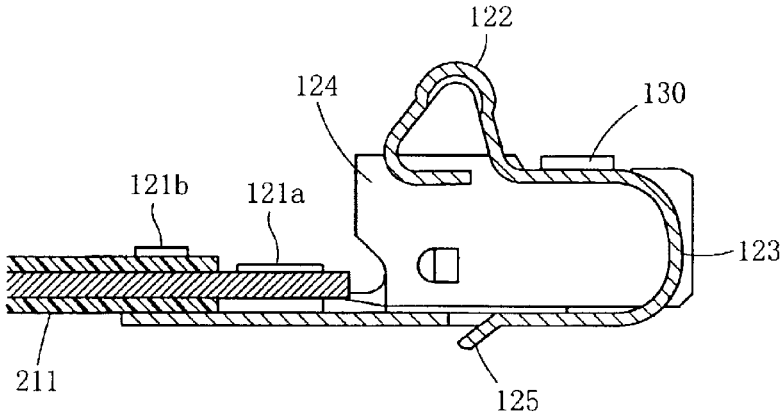
FIG. 6A and FIG. 6B are sectional views showing the contact of the electric connector of the first embodiment.
Figure 6B:
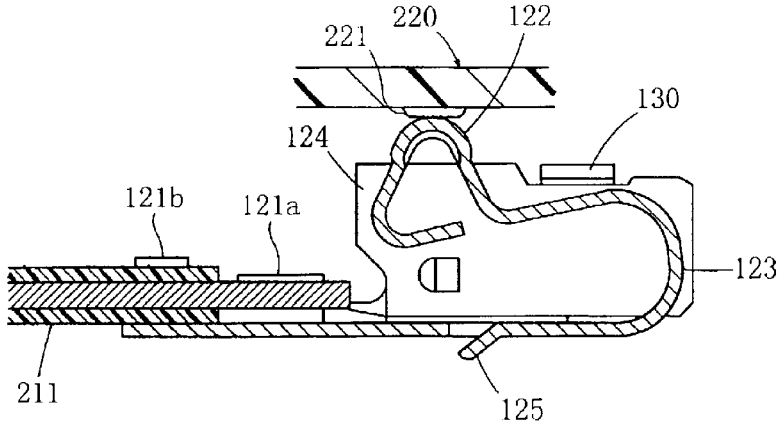

As shown in FIG. 5, FIG. 6A and FIG. 6B, the above-mentioned contact 120 is made of a member that has electric conductivity, and this contact 120 comprises a connecting part 121, which is connected to the conductive part 211 of the first article 210, a contacting point 122, which contacts the conductive part 221 of the second article 220, and an elastic part 123, which undergoes elastic deformation when the contacting point 122 is pressed. In this embodiment, the contact 120 is exemplified by a crimp type contact 120. Hence the connecting part 121 is a barrel formed on the contact 120, and this barrel comprises a wire barrel 121*a*, which crimps the core of an electric wire being the conductive part 211, and an insulation barrel 121*b*, which crimps this electric wire together with its insulation. The elastic part 123 is a cantilevered leaf spring, which is bent approximately into a U shape, and the contacting point 122 is provided at the free end of the elastic part 123. In other words, the elastic part 123 is formed into an oblong rectangle when seen in the height direction, and into an approximate U shape when seen in the width direction, and its fixed end is fixed to the contact 120, and the elastic part 123 functions as a cantilevered leaf spring, of which free end flexes elastically in the height direction. The free end is bent into an inverted-U shape in the height direction to form the contacting point 122, and this contacting point 122 comes out of the face of the housing 110 through the contact window 113 of the above-mentioned housing 110.

At least either the housing 110 or the contact 120 is provided with a holding member 130, which holds the elastic part 123 in an elastically deformed condition in advance in the direction of pressing the contacting point 122 and prevents it from restoring. In the case of this embodiment, the holding member 130 presses a free-end side part of the elastic part 123 from the outside to curve the elastic part 123 more than its unloaded state. Guide walls 124 rise from both ends, in the width direction, of the contact 120, and a protruding piece provided on the top end of each guide wall 124 is bent inward to form the holding member 130. The holding member 130 contacts, from the above, an intermediate part of the free-end side portion of the elastic part 123 to press it.

The configuration of the contact is not limited by this embodiment. The contact may be bent into, for example, an L shape without any curving. When necessary, a dimple is formed in this contacting point 122 by embossing or the like to define a contacting point for the conductive part 221 of the second article 220. In this embodiment, a fitting structure with the so-called contact lance is used. In other words, the contact 120 is provided with a protruding piece 125, and this protruding piece 125 is used as a lance to be fitted into a fitting window 115 that is opened in the cavity 111 of the housing 110. In contrast with this, a fitting structure with the so-called housing lance may be used. In that case, the housing is provided with a protruding piece and this protruding piece is fitted into a fitting window of the contact. The contact may be fitted into the housing without using any lance.

The above-mentioned housing 110 is fitted onto an article by fitting itself into a concaved part formed in the article. In the case of the connecting form shown in FIG. 1 through FIG. 3, the housing 110 is fitted onto the first article 210. To this end, a groove-shaped concaved part 212 is formed in the first article 210, and the width of the housing 110 is made to have a dimension that can fit into this concaved part 212. The electric connector 100 is fitted into this concaved part 212 in such a way that the height direction of the electric connector 100 aligns with the depth direction of the concaved part 212 and the contacting point 122 comes out of the concaved part 212. On each of the two longitudinal walls 212*a* of this concaved part 212, which are opposing to each other, a guide protrusion 213 is formed to extend in the depth direction. In each of both the faces 116, in the width direction, of the housing 110, a fitting groove 114, into which the above-mentioned guide protrusion 213 fits, is formed to extend in the height direction in a fitting member 114A that is provided on and protrudes from a sidewall 110A of the housing 110. The lower end of the fitting groove 114 has a widening beveled or tapered mouth portion 114B. The groove 114 is bordered by adjoining flat planar faces 114C of the fitting member 114A. The fitting grooves 114 and the guide protrusions 213 fit together with a certain pressure, and the housing 110 is fitted onto the first article 210 by this fitting (the state shown in FIG. 1 and FIG. 2). Here, fitting grooves 114 are formed in the electric connector 100 and guide protrusions 213 are formed on the concaved part 212. However, in contrast with this, guide protrusions may be formed on the electric connector and fitting grooves may be formed in the concaved part. Here, the concaved part 212 is groove-shaped, but the concaved part may have any form provided that it can store the electric connector. Moreover, instead of providing fitting grooves and guide protrusions, the faces of the housing may be made to face-contact the longitudinal walls of the concaved part and the housing may be fitted onto the first article by this fitting. These comments also apply to the concaved parts 212, 225, which will be described in relation to the connecting forms that will be described below.

In the case of the connecting form shown in FIG. 1 through FIG. 3, when the connecting part 121 of the contact 120 of the electric connector 100 is connected to the conductive part 211 of the first article 210, the housing 110 is fitted onto the first article 210, and the two articles 210, 220 are arranged in a certain positional relationship and joined together, the contacting point 122 of the contact 120 will contact the conductive part 221 of the second article 220 with a pressing force, and the conductive parts 211, 221 of both the articles 210, 220 will be electrically connected to each other via the contact 120. The method of arranging the two articles 210, 220 in a certain positional relationship and joining together is effected by, for example, assembling a printed circuit board being the second article 220 into a casing of an electric appliance being the first article 210 and joining the former to the latter by screwing, etc.

Figure 7:
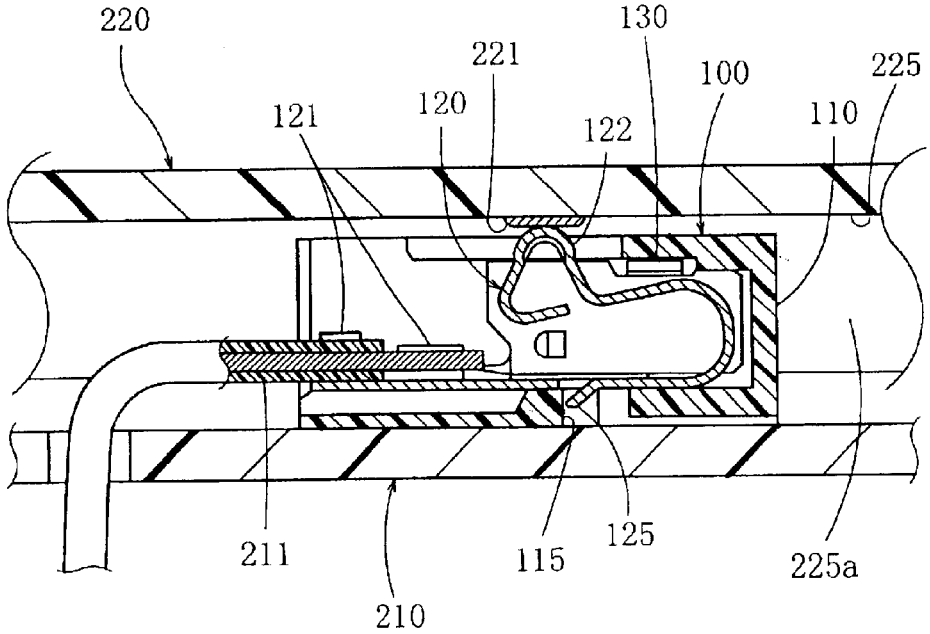
FIG. 7 is a sectional view of the electric connector of the first embodiment when it is used by fitting it onto the second article.
Figure 8:
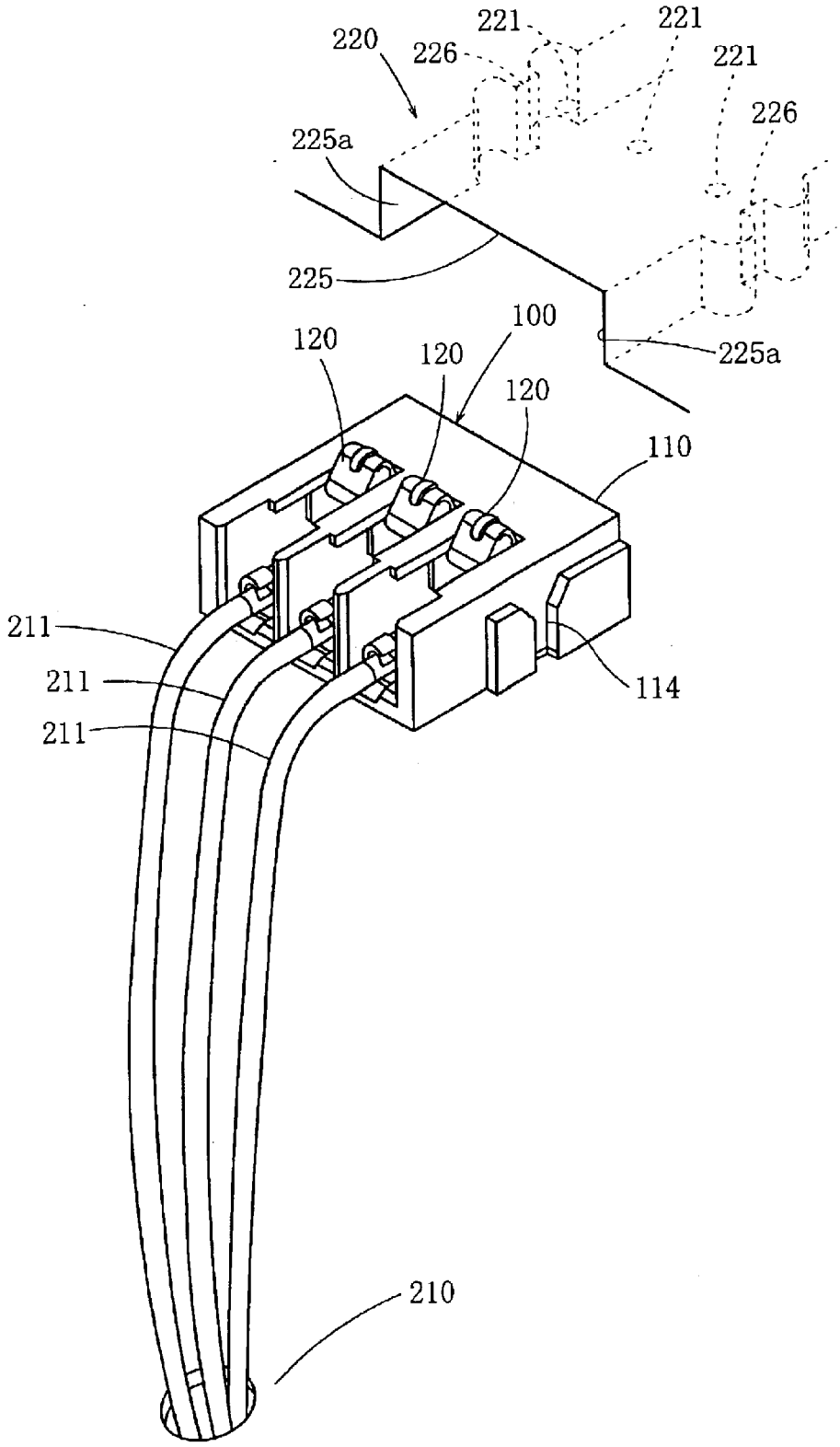
FIG. 8 is a perspective view of the electric connector of the first embodiment when it is fitted onto the second article.

FIG. 7 and FIG. 8 show another connecting form of the electric connector 100 of the above-mentioned first embodiment. In this case, the housing 110 is fitted onto the second article 220. To this end, a groove-shaped concaved part 225 is formed in the second article 220, and the width of the housing 110 is made to have a dimension that can fit into this concaved part 225. The conductive part 221 of the second article 220 is provided on the bottom of the concaved part 225. The electric connector 100 is fitted into this concaved part 225 in such a way that the height direction of the electric connector 100 aligns with the depth direction of the concaved part 225 and the contacting point 122 opposes to the bottom of the concaved part 225. On each of the two longitudinal walls 225*a* of this concaved part 225, which are opposing to each other, a guide protrusion 226, which fits into a fitting groove 114 of the housing 110, is formed to extend in the depth direction. These fitting grooves 114 and the guide protrusions 226 fit together with a certain pressure, and the housing 110 is fitted onto the second article 220 by this fitting.

In the case of this connecting form, when the connecting part 121 of the contact 120 of the electric connector 100 is connected to the conductive part 211 of the first article 210, and the housing 110 is fitted onto the second article 220, the contacting point 122 of the contact 120 will contact the conductive part 221 of the second article 220 with a pressing force, and the conductive parts 211, 221 of both the articles 210, 220 will be electrically connected to each other via the contact 120.

Figure 9:
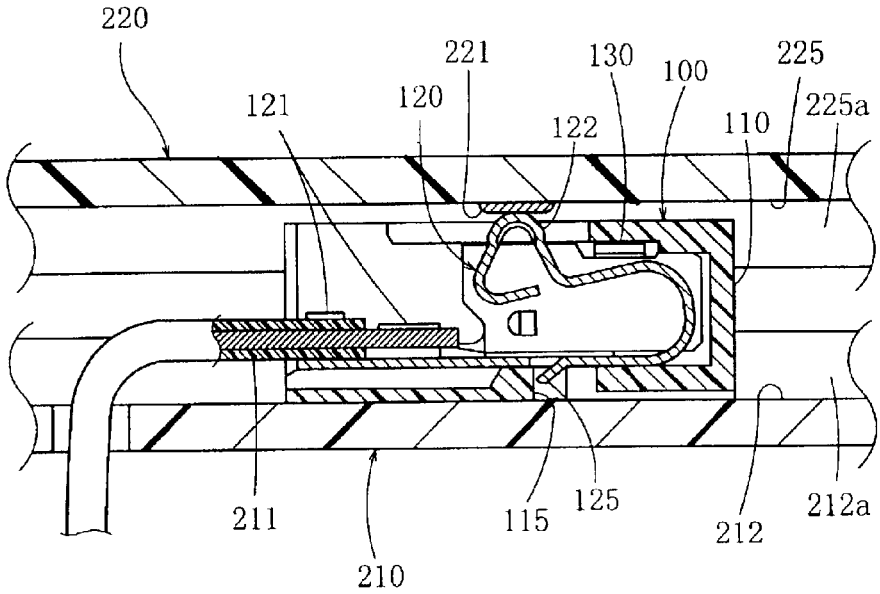
FIG. 9 is a sectional view of the electric connector of the first embodiment when it is fitted onto both the first article and the second article.

FIG. 9 shows another connecting form of the electric connector 100 of the above-mentioned first embodiment. In this case, the housing 110 is fitted onto the first article 210 and the second article 220. To this end, a groove-shaped concaved part 212 is formed in the first article 210, and a groove-shaped concaved part 225 is formed in the second article 220, respectively, and the width of the housing 110 is made to have a dimension that can be fitted into both the concaved parts 212, 225. The conductive part 221 of the second article 220 is provided on the bottom of the concaved part 225. The electric connector 100 is fitted into the concaved part 212 in such a way that the height direction of the electric connector 100 aligns with the depth direction of the concaved part 212 and the contacting point 122 comes out of the concaved part 212, and the electric connector 100 is fitted into the concaved part 225 in such a way that the height direction of the electric connector 100 aligns with the depth direction of the concaved part 225 and the contacting point 122 opposes to the bottom of the concaved part 225. Guide protrusions 213, 226 are formed on the concaved parts 212, 225, and the fitting grooves 114 and the guide protrusions 213, 226 are fitted together with a certain pressure, and the housing 110 is fitted onto both the first article 210 and the second article 220 by this fitting.

In the case of this connecting form, when the connecting part 121 of the contact 120 of the electric connector 100 is connected to the conductive part 211 of the first article 210 and the housing 110 is fitted onto both the first article 210 and the second article 220, the contacting point 122 of the contact 120 will contact the conductive part 221 of the second article 220 with a pressing force, and the conductive parts 211, 221 of both the articles 210, 220 will be electrically connected to each other via the contact 120.

In any of the above-mentioned connecting forms, this connecting structure uses one electric connector in contrast with the conventional connecting structure wherein a pair of a male crimp connector and a female crimp connector are used. Accordingly, the costs are reduced through the reduction in the number of electric connectors used. As the work of connecting the conductive part 211 to the electric connector 100, which is exemplified by crimping, can be done by one operation, the costs are reduced through improvement in the workability. When the housing 110 is fitted onto both the first article 210 and the second article 220, as the two articles 210, 220 are joined together by the electric connector 100, there is no need of independently joining the two articles 210, 220 by a joining means such as screws. Hence costs are reduced through elimination of a joining means. As only one electric connector 100 is used in the connecting structure, in contrast with the conventional connecting structure using a pair of a male crimp connector and a female crimp connector, the space occupied by the electric connector is smaller and the connecting structure is more compact.

In this case, as shown in FIG. 6A, as the elastic part 123 is elastically deformed in advance by the holding member 130 in the direction of pressing the contacting point 122 and held to prevent its restoration, a restoring force is accumulated. Accordingly, as shown in FIG. 6B, when the contacting point 122 contacts the conductive part 221 of the second article 220, a contact pressure corresponding to the above-mentioned restoring force is generated upon the initial contacting. When the elastic part 123 is pressed further against the conductive part 221 of the second article 220, the contact pressure will increase. With this arrangement, even if, for example, the relative positional relationship between the electric connector 100 and the articles 210, 220 onto which the electric connector is fitted or the relative positional relationship between the articles 210, 220 is off the set points and the amount of elastic deformation of the elastic part 123 is reduced, a high contact pressure will be obtained upon the initial contact and a reliable electric connection will be made between the articles.

According to the present invention, the elastic part may be any elastic member, which exhibits a function that it undergoes elastic deformation when the contacting point is pressed, and the holding member may be any member, which exhibits functions of holding the elastic part in an elastically deformed condition in advance in the direction of pressing the contacting point and preventing the restoring thereof. In the above-mentioned embodiment, the elastic part 123 is a cantilevered leaf spring, which is bent approximately into a U shape, the contacting point 122 is provided on the free end of the elastic part 123, and the holding member 130 presses a free-end side part of the elastic part 123 from the outside to curve the elastic part 123 more than its unloaded state. With this arrangement, when the elastic part 123 bends more under the pressure of the holding member 130, more restoring force will be stored. Thus the elastic part 123 is realized by a simple structure using a leaf spring.

The present invention includes any forms of structure for fitting the housing of the electric connector onto an article. However, as is the case of the above-mentioned embodiment, if the housing 110 is formed to be fitted into the concaved part 212 of the article 210 and/or the concaved part 225 of the article 220 and the housing 110 is formed to be fitted onto the article 210 and/or the article 220 by this fitting-into, fitting the electric connector 100 into the concaved part 212 of the article 210 and/or the concaved part 225 of the article 220 will fit the electric connector 100 onto the article 210 and/or the article 220. Hence the workability of fitting is improved.

The present invention includes any forms of structure for connecting the connecting part of the contact to the conductive part of an article. Among them, the above-mentioned embodiment exemplifies a case wherein the contact 120 is of the crimp type.

In the following, other embodiments will be described. As the basic description of these other embodiments, the description of the first embodiment will be repeated for these other embodiments without modifying the reference numbers or characters. Then configurations differing from the first embodiment will be described additionally.

Figure 10:
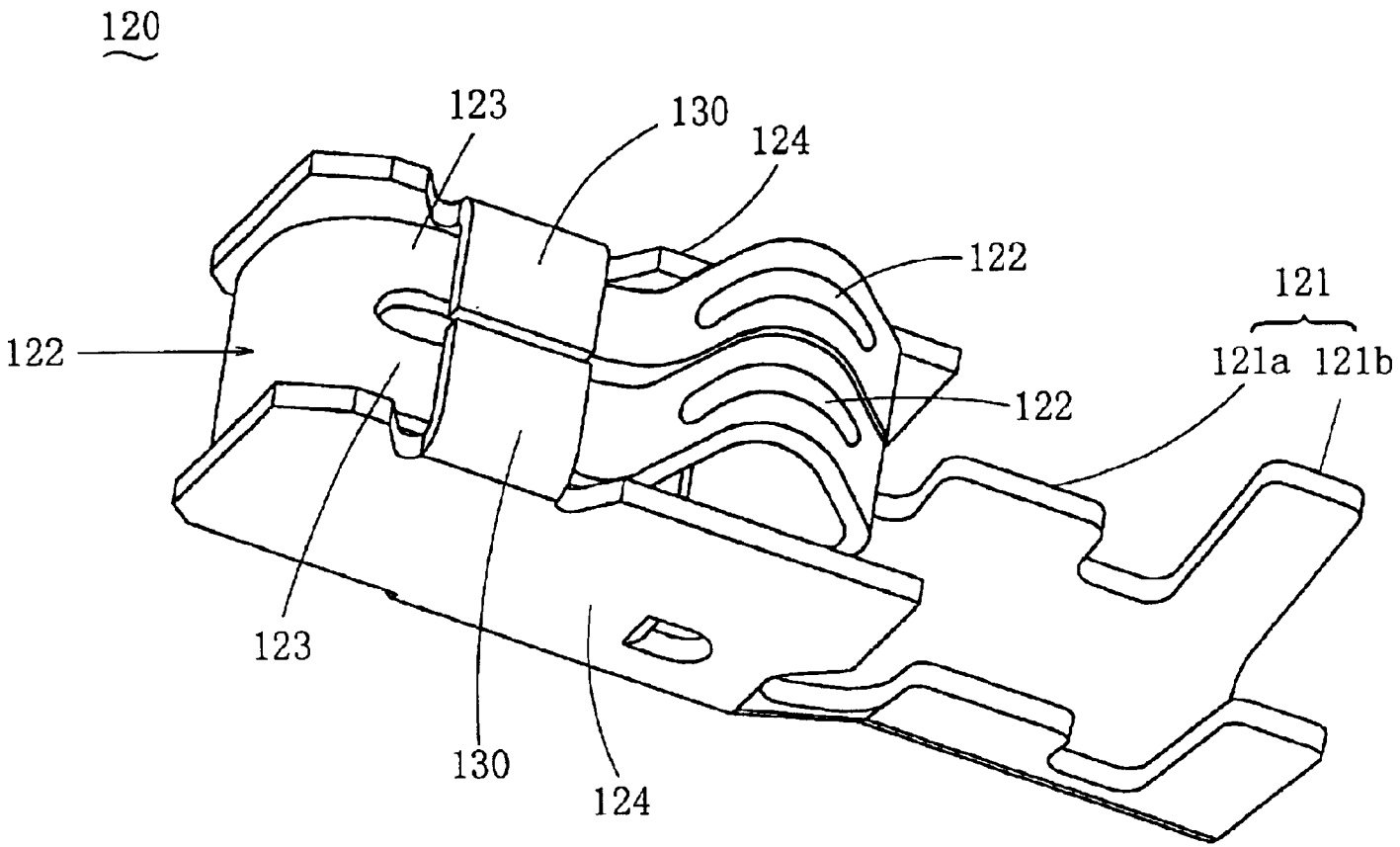
FIG. 10 is a perspective view of the contact of the electric connector of the second embodiment.

FIG. 10 shows the second embodiment. Like the first embodiment, the contact 120 of the electric connector 100 of the second embodiment comprises a connecting part 121, which is connected to the conductive part 211 of the first article 210, a contacting point 122, which contacts the conductive part 221 of the second article 220, and an elastic part 123, which undergoes elastic deformation when the contacting point 122 is pressed. The second embodiment differs from the first embodiment in that two or more sets of a contacting point 122 and an elastic part 123 are provided. In the case of this embodiment, the elastic part 123 is a cantilevered leaf spring, which is bent approximately into a U shape, and the elastic part 123 is branched into two or more parts, and two or more free ends of the elastic part 123 are provided with a contacting point 122, respectively. At least either the housing 110 or the contact 120 is provided with a holding member 130, which holds the elastic part 123 in an elastically deformed condition in advance in the direction of pressing the contacting point 122 and prevents the restoring thereof. In this embodiment, a case wherein two sets of a contacting point 122 and an elastic part 123 are used is shown as an example.

The second embodiment can exhibit operation and effect similar to those of the first embodiment. Moreover, even if, for example, the relative positional relationship between the electric connector 100 and the articles 210, 220 onto which the electric connector 100 is fitted or the relative positional relationship between the articles 210, 220 is off the set points, the contact 120 and the conductive part 221 of the second article 220 will contact together with a high probability, and an electric connection will be made reliably between the articles. This is because two or more sets of a contacting point 122 and an elastic part 123 are provided; even if a contacting point 122 may fail to contact the conductive part 221 of the second article 220, another contacting point 122 will contact the conductive part 221 of the second article 220.

The present invention includes all embodiments wherein two or more sets of a contacting point and an elastic part are provided. Among them, the above-mentioned second embodiment is a case wherein the elastic part 123 is a cantilevered leaf spring, which is bent approximately into a U shape, and the elastic part 123 is branched into two or more parts, and each of two or more free ends of the elastic part 123 is provided with a contacting point 122. With this arrangement, when the degree of bending of the elastic part 123 is increased, more restoring force will be stored. The elastic part 123 is realized by a simple structure using a leaf spring.

The present invention includes all embodiments wherein two or more sets of a contacting point and an elastic part are provided and no holding member is provided. Among them, the above-mentioned second embodiment is a case wherein at least either the housing 110 or the contact 120 is provided with a holding member 130, which holds the elastic part 123 in an elastically deformed condition in advance in the direction of pressing the contacting point 122 and prevents the restoring thereof. With this arrangement, as the elastic part 123 is elastically deformed in advance by the holding member 130 in the direction of pressing the contacting point 122 and held to prevent its restoration, a restoring force is accumulated. Accordingly, when the contacting point 122 contacts the conductive part 221 of the second article 220, a contact pressure corresponding to the above-mentioned restoring force will be generated upon the initial contacting. When the elastic part 123 is pressed further against the conductive part 221 of the second article 220, the contact pressure will increase. With this arrangement, even if, for example, the relative positional relationship between the electric connector 100 and the articles 210, 220 onto which the electric connector 100 is fitted or the relative positional relationship between the articles 210, 220 is off the set points and the amount of elastic deformation of the elastic part 123 is reduced, a high contact pressure will be obtained upon the initial contact.

Figure 11:
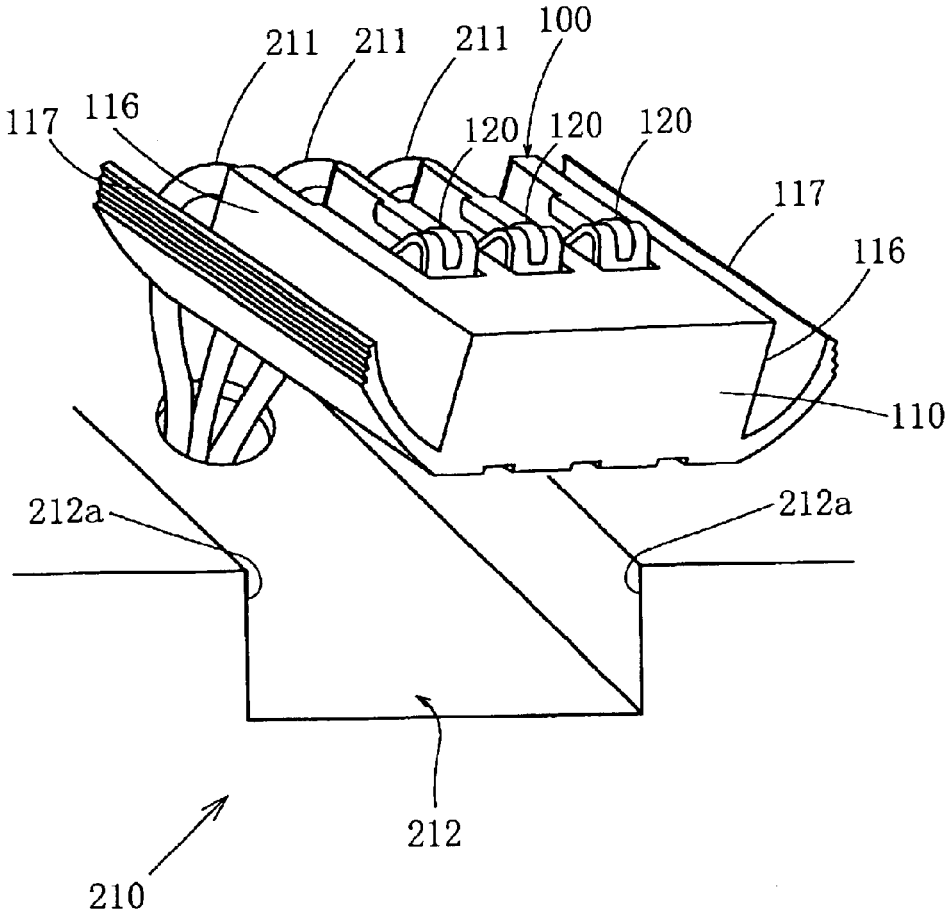
FIG. 11 is a perspective view of the electric connector of the third embodiment when it is fitted onto the first article.
Figure 12:
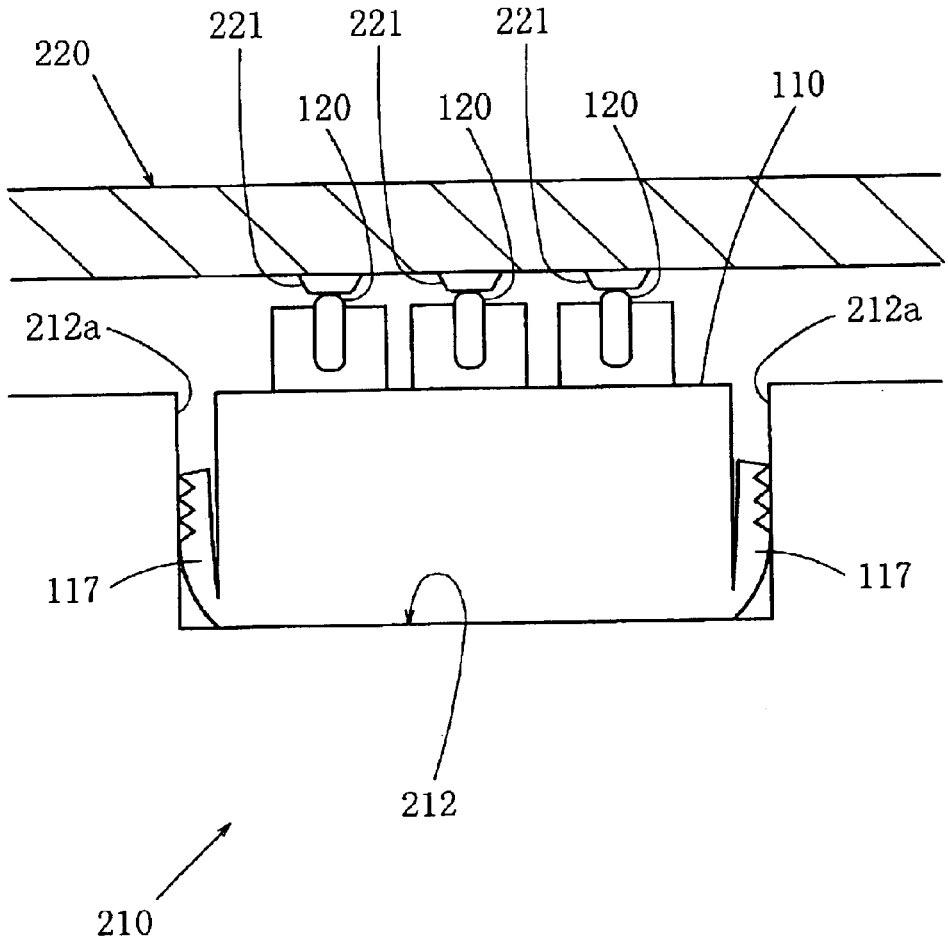
FIG. 12 is a front view of the electric connector of the third embodiment when it is used by fitting it onto the first article.

FIG. 11 and FIG. 12 show the electric connector 100 of the third embodiment. The housing 110 of the electric connector 100 of this third embodiment is formed in such a way that it can be inserted into a concaved part formed in an article and is provided with wings 117, which are elastically deformed to press against the longitudinal walls of a concaved part when the housing 110 is inserted into the concaved part. The housing 110 is fitted onto the article by the pressures of the wings 117. In this embodiment, a wing 117 is provided on each of two faces 116 on both ends, in the width direction, of the housing 110. In the case of the connecting form shown in FIG. 9 and FIG. 10, the housing 110 is fitted onto the first article 210. To this end, a concaved part 212 is formed in the first article 210 and the housing 110 is formed in such a way that it can be inserted into the concaved part 212, and the housing 110 is provided with wings 117, which are elastically deformed to press against the longitudinal walls 212*a* of the concaved part 212 when the housing 110 is inserted into the concaved part 212. The electric connector 100 is fitted into this concaved part 212 in such a way that the height direction of the electric connector 100 aligns with the depth direction of the concaved part 212 and the contacting point 122 comes out of the concaved part 212. The method of electrically connecting the articles 210, 220 with the electric connector 100 in this connecting form is similar to that of the connecting form shown in FIG. 1 through FIG. 3.

Figure 13:
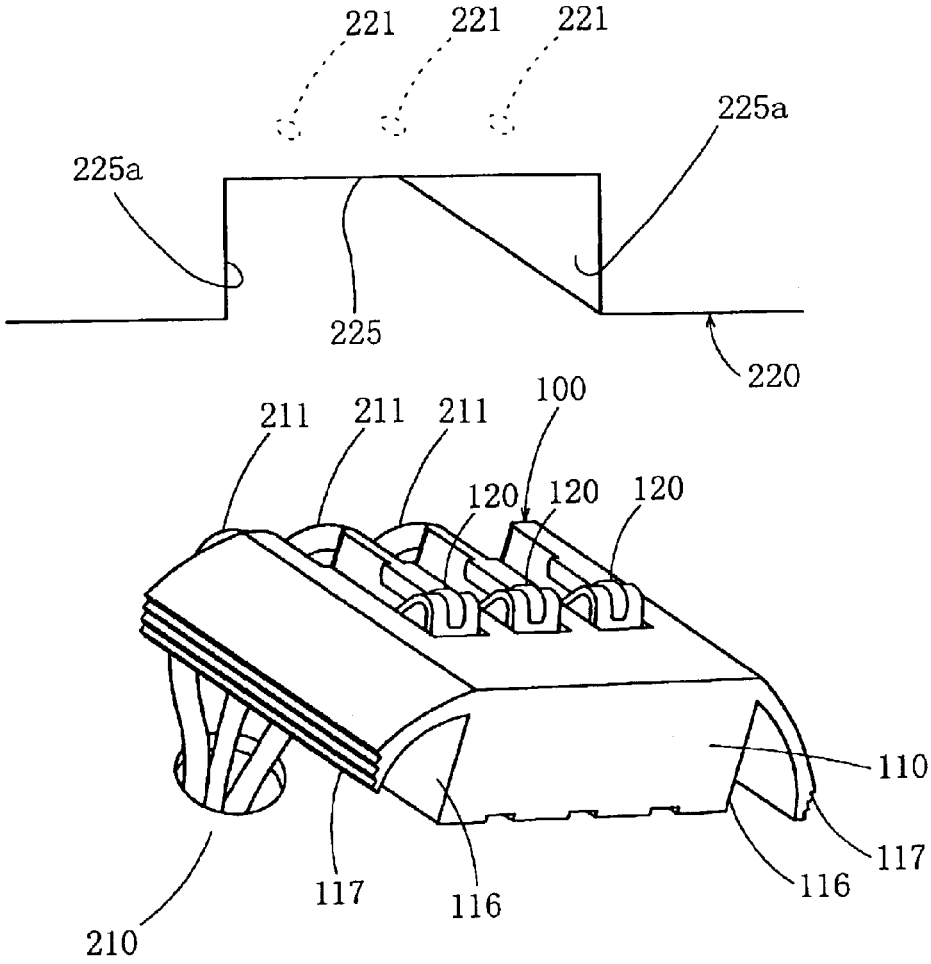
FIG. 13 is a perspective view of the electric connector of the third embodiment when it is fitted onto the second article.

FIG. 13 shows another connecting form of the electric connector 100 of the above-mentioned third embodiment. In the case of this connecting form, the housing 110 is fitted onto the second article 220. To this end, a concaved part 225 is formed in the second article 220, and the housing 110 is formed in such a way that it can be inserted into the concaved part 225 and is provided with wings 117, which are elastically deformed to press against the longitudinal walls 225*a* of the concaved part 225 when the housing 110 is inserted into the concaved part 225. The electric connector 100 is fitted into this concaved part 225 in such a way that the height direction of the electric connector 100 aligns with the depth direction of the concaved part 225 and the contacting point 122 opposes to the bottom of the concaved part 225. The method of electrically connecting the articles 210, 220 with the electric connector 100 in this connecting form is similar to that of the connecting form shown in FIG. 7 and FIG. 8.

The third embodiment in each connecting form can exhibit operation and effect similar to those of the first embodiment, and the third embodiment provides high fitting force with a simple construction. Moreover, as dimensional errors, which occur in the internal dimensions of the concaved parts 212, 225, are absorbed by flections of the wings 117, the yields of the articles 210, 220 and the electric connector 100 are improved. When the wings 117 are provided on both ends, in the width direction, of the housing 110, the elastic restoring forces of the wings 117 will work on both the ends, in the width direction, of the housing 110 and, in turn, after fitting, the electric connector 100 will be held stably on the articles 210, 220. This is preferable.

Figure 14:
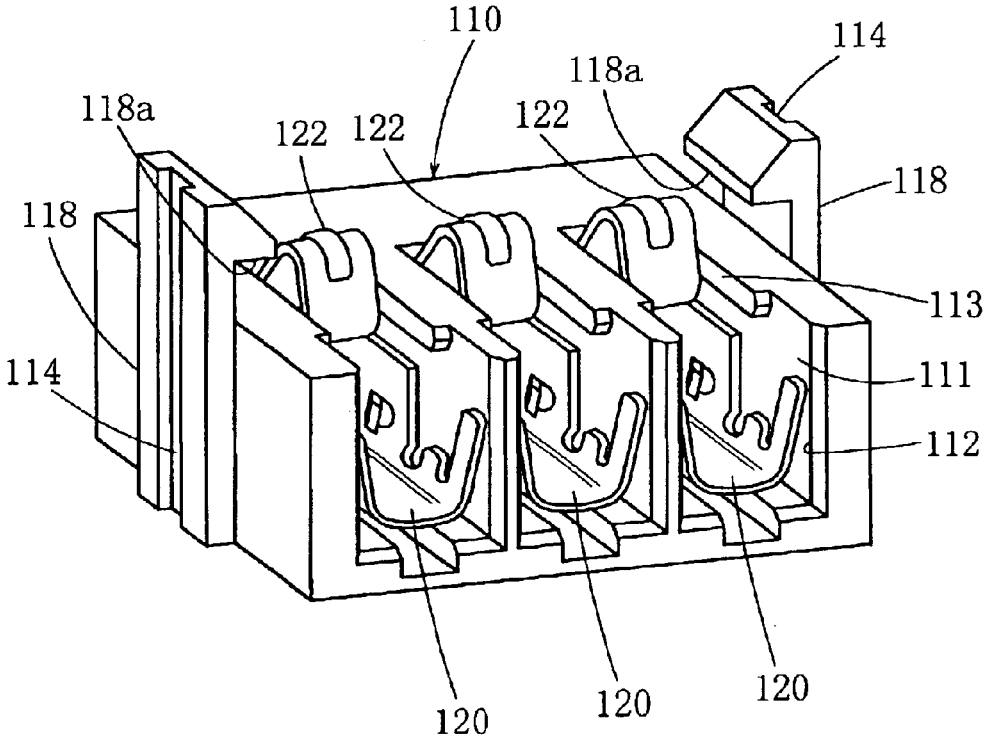
FIG. 14 is a perspective view of the electric connector of the fourth embodiment.
Figure 15:
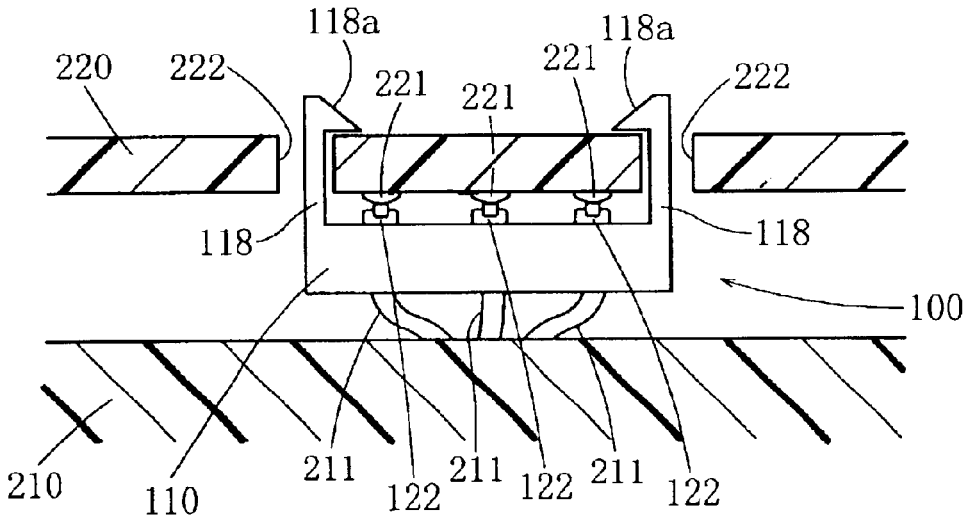
FIG. 15 is a front view of the electric connector of the fourth embodiment when it is used by fitting it onto the second article.

FIG. 14 shows the electric connector 100 of the fourth embodiment. In the electric connector 100 of this fourth embodiment, the housing 110 is provided with locking pawls 118, and the housing 110 is fitted onto an article by fitting the locking pawls 118 onto the article. In the case of this embodiment, the locking pawls 118 extend on both ends, in the width direction, of the housing 110 in the direction of height. A hook 118*a* extending in the width direction is provided on the top end of each locking pawl 118, and this hook 118*a* enters a locking hole formed in an article and hooks on the edge of the locking hole. In the case of the connecting form shown in FIG. 15, the housing 110 is fitted onto the second article 220. To this end, locking holes 222 are formed in the second article 220, and the locking pawls 118 extend protrusively from the face of the housing 110, on which the contacting points 122 are exposed. The electric connector 100 is held in such a way that the contacting points 122 oppose to the conductive parts 221 of the second article 220, and the locking pawls 118 are fitted on the second article 220. The method of electrically connecting the articles 210, 220 with the electric connector 100 in this connecting form is similar to that of the connecting form shown in FIG. 7 and FIG. 8.

Figure 16:
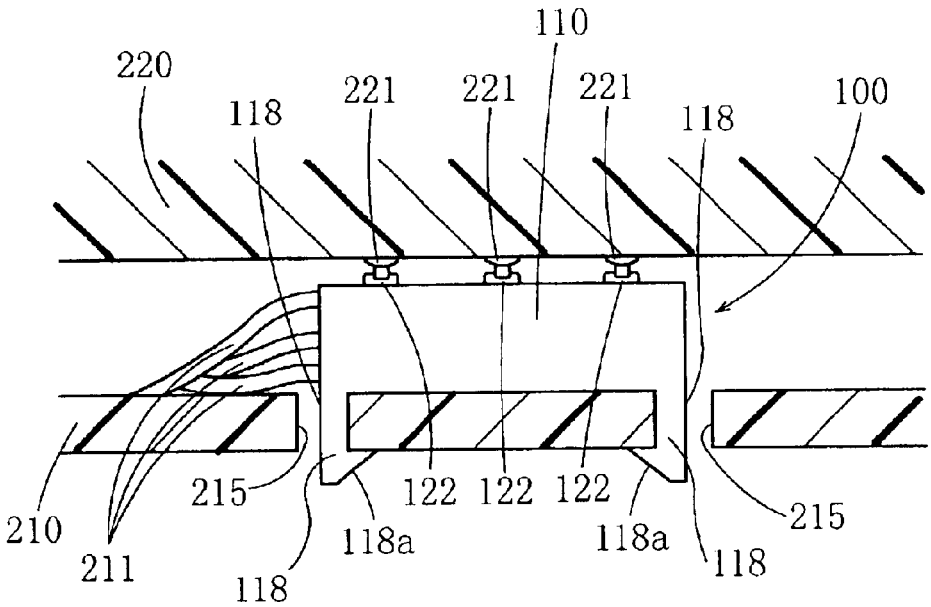
FIG. 16 is a front view of the electric connector of the fourth embodiment when it is used by fitting it onto the first article.

FIG. 16 shows another connecting form of the electric connector 100 of the above-mentioned fourth embodiment. In the case of this connecting form, the housing 110 is fitted onto the first article 210. To this end, locking holes 215 are formed in the first article 210, and the locking pawls 118 extend protrusively from the face of the housing 110, which is opposite, in the height direction, to the face on which the contacting points 122 are exposed. The electric connector 100 is held in such a way that the face being opposite, in the height direction, to the contacting points 122 opposes to the first article 210, and the locking pawls 118 are fitted onto the first article 210. The method of electrically connecting the articles 210, 220 with the electric connector 100 in this connecting form is similar to that of the connecting form shown in FIG. 1 through FIG. 3.

The fourth embodiment in each connecting form exhibits operation and effect similar to those of the first embodiment, and high fitting force is provided by a simple structure. When the locking pawls 118 are provided on both ends, in the width direction, of the housing 110, the fitting forces of the locking pawls 118 will work on both ends, in the width direction, of the housing 110, and, in turn, the electric connector 100 will be held stably on both the articles 210, 220 after fitting, and this is preferable.

Figure 17:
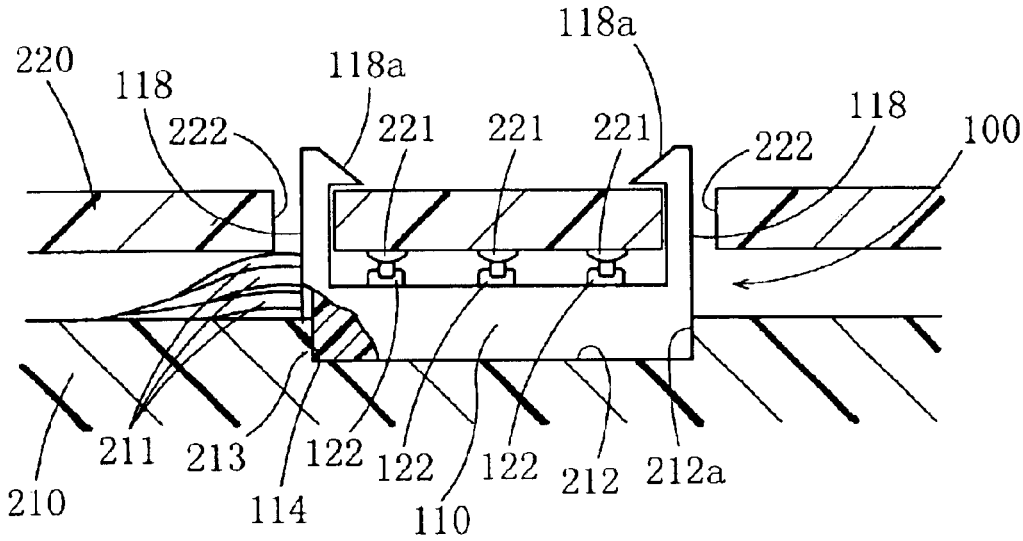
FIG. 17 is a front view of the electric connector of the fourth embodiment when it is used by fitting it onto both the first article and the second article.

The present invention includes all embodiments wherein features of the embodiments described above are combined. The fitting forms of the first embodiment, the fitting forms of the third embodiment, and the fitting forms of the fourth embodiment can be combined in the form of fitting one housing 110 onto both the first article 210 and the second article 220, and the present invention includes all of these embodiments. One example shown in FIG. 17 is an embodiment wherein one housing 110 is fitted onto the first article 210 by the fitting form of the first embodiment and onto the second article 220 by the fitting form of the fourth embodiment. In the case of this embodiment, as shown in FIG. 14, when necessary, a fitting groove 114 is provided in the outside face of each locking pawl 118 and guiding protrusions 213 are provided on the first article 210. In this way, the fitting-in force between the housing 110 and the concaved part 212 can be increased. When this form of fitting one housing 110 onto both the first article 210 and the second article 220 is used, as explained in relation to the first embodiment, in addition to the operation and effect that are obtained by the form of fitting one housing 110 onto the first article 210 or the second article 220, the two articles 210, 220 will be joined together by the electric connector 100. Hence there will be no need of separately joining the two articles 210, 220 by a joining means such as screw. Thus the costs are reduced through the elimination of a joining means.

Figure 18:
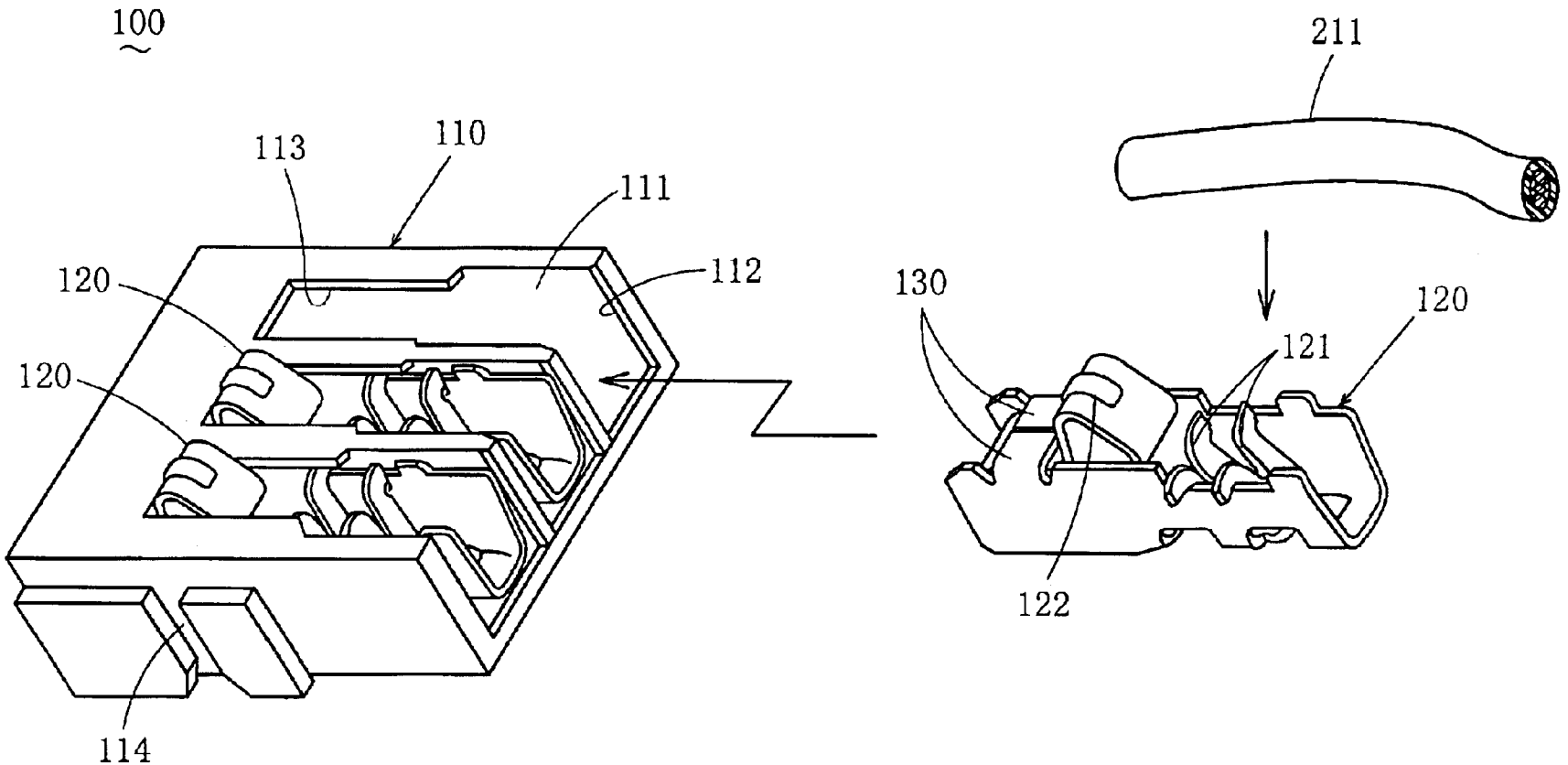
FIG. 18 is a perspective view of the disassembled electric connector of the fifth embodiment.

FIG. 18 shows the fifth embodiment. The fifth embodiment is applicable to any of the above-mentioned embodiments. The electric connector 100 of this fifth embodiment differs from the electric connectors 100 of the first embodiment through the fourth embodiment in that the contact 120 is of the insulation displacement connection type, and is identical to them in other aspects of the construction. Accordingly, the connecting part 121 is a slot that is formed in one end, in the longitudinal direction, of the contact 120. The core of the electric wire being the conductive part 211 of the first article 210 is connected to this slot by insulation displacement connection.

In the fifth embodiment, when the contact 120 of the electric connector 100 is to be connected to the electric wire being the conductive part 211 of the first article 210, the slot being the connecting part 121 of the contact 120 is connected to the electric wire by insulation displacement connection.

In addition to the embodiments mentioned above, the present invention includes a variety of embodiments. For example, the present invention includes embodiments wherein the housing is fitted onto an article by using an adhesive, embodiments wherein the housing is fitted onto an article by using a tape or the like, which achieves fitting by a frictional force, for example, Velcro fastener, and embodiments wherein the conductive part of the first article is a conductive pad and electric connection is made by fitting the electric connector onto the first article and having the contact contact this conductive pad.

With the description of these embodiments, the first electric connector, which was described in the summary of the invention, has been fully disclosed. Moreover, with the description of these embodiments, the second electric connector through the fifth electric connector, which will be described below, have been fully disclosed.

The second electric connector is an electric connector as recited in the first electric connector wherein the elastic part is a cantilevered leaf spring, which is approximately bent into a U shape, the contacting point is provided on the free end of the elastic part, and the holding member presses a free-end side part of the elastic part from the outside to curve the elastic part more than its unloaded state. With this arrangement, when the holding member presses to increase the degree of bending of the elastic part, more restoring force will be stored. The elastic part is realized by a simple structure using a leaf spring.

The third electric connector is an electric connector, which is used to electrically connect two articles each having a conductive part. This electric connector comprises a housing, which is fitted onto at least one of the articles, and a contact, which is provided on the housing, and the contact comprises a connecting part, which is connected to the conductive part of the first article, a contacting point, which contacts the conductive part of the second article, and an elastic part, which undergoes elastic deformation when the contacting point is pressed, and the contact is provided with two or more sets of a contacting point and an elastic part.

When the connecting part of the contact of this electric connector is connected to the conductive part of the first article, the housing is fitted onto the first article, and the two articles are arranged in a certain positional relationship and joined to each other, the contacting points will, due to the restoring force of the elastic parts, contact the conductive part of the second article with a pressing force, and the conductive parts of both the articles will be electrically connected to each other via the contact. Or when the connecting part of the contact of this electric connector is connected to the conductive part of the first article, and the housing is fitted onto the second article, the contacting points will, due to the restoring force of the elastic parts, contact the conductive part of the second article with a pressing force, and the conductive parts of both the articles will be electrically connected to each other via the contact. Or when the connecting part of the contact of this electric connector is connected to the conductive part of the first article, and the housing is fitted onto both the first article and the second article, the contacting points will, due to the restoring force of the elastic parts, contact the conductive part of the second article with a pressing force, and the conductive parts of both the articles will be electrically connected to each other via the contact.

In any of the above-mentioned connecting forms, as the number of electric connector to be used by this connecting structure is one in contrast with the conventional connecting structure using a pair of a male crimp connector and a female crimp connector, the costs are lowered through the reduction in the number of electric connector in use. As the work of connecting the conductive part to the electric connector, which is exemplified by crimping, can be done by a single operation, the costs are lowered through the improved workability. When the housing is fitted onto both the first article and the second article, as the two articles will be joined together via the electric connector, a separate joining means such as a screw is not needed to join the two articles together, and the costs are reduced through the elimination of any joining means. As a single electric connector is used in the connecting structure, the space occupied by the electric connector is reduced in comparison with the conventional connecting structure wherein a pair of a male crimp connector and a female crimp connector are used, and the connecting structure is compactified.

In this case, even if, for example, the relative positional relationship between the electric connector and the article onto which the electric connector is fitted or the relative positional relationship between the articles is off the set points, the contact and the conductive part of the second article will contact together with a high probability, and an electric connection will be made reliably between the articles. This is because two or more sets of a contacting point and an elastic part are provided; even if a contacting point may fail to contact the conductive part of the second article, another contacting point will contact the conductive part of the second article.

Accordingly, the third electric connector achieves significant cost reduction and compactification of the connecting structure through reduction in the number of electric connector in use and improved workability. When the housing is fitted onto both the first article and the second article, the costs can be reduced through elimination of a joining means. In that case, even if, for example, the relative positional relationship between the electric connector and the article onto which the electric connector is fitted or the relative positional relationship between the articles is off the set points, the contact and the conductive part of the first article will contact together with a high probability since two or more sets of a contacting point and an elastic part are provided, and an electric connection will be made reliably between the articles.

The fourth electric connector is an electric connector as recited in the third electric connector wherein the elastic part is a cantilevered leaf spring, which is bent approximately into a U shape, and the elastic part is branched into two or more parts, and each of two or more free ends of the elastic part is provided with a contacting point. With this arrangement, when the degree of bending of the elastic part is increased, more restoring force will be stored. The elastic part is realized by a simple structure using a leaf spring.

The fifth electric connector is an electric connector as recited in the third electric connector or the fourth electric connector wherein at least either the housing or the contact is provided with a holding member, which holds the elastic part in an elastically deformed condition in advance in the direction of pressing the contacting point and prevents the restoring thereof. With this arrangement, in addition to the operation of the third electric connector or the fourth electric connector, restoring force is stored since the elastic part is held in an elastically deformed condition in advance in the direction of pressing the contacting point and prevented from restoring. Accordingly, when the contacting point contacts the conductive part of the second article, a contact pressure corresponding to the above-mentioned restoring force is generated upon the initial contacting. When the elastic part is pressed further against the conductive part of the second article, the contact pressure will increase. With this arrangement, even if, for example, the relative positional relationship between the electric connector and the article onto which the electric connector is fitted or the relative positional relationship between the articles is off the set points and the amount of elastic deformation of the elastic part is reduced, a high contact pressure will be obtained upon the initial contact. Thus a reliable electric connection will be made between the articles by securing a sufficient contact pressure at the contacting point.

What is claimed is:

1. An electrical connector for electrically connecting a first conductive part of a first article with a second conductive part of a second article, said electrical connector comprising an electrically conductive contact member that comprises:

two contact member sidewalls extending parallel to one another with a space therebetween;

a connecting part adapted to be mechanically and electrically connected to the first conductive part of the first article;

a contacting part adapted to electrically contact the second conductive part of the second article;

a flexible elastic part that extends between and interconnects said connecting part and said contacting part and includes a U-shaped curved portion between said connecting part and said contacting part, and that is elastically flexed into an elastically preloaded condition and is further elastically deflectable when said contacting part is pressed, so that said contacting part is movably supported by said flexible elastic part so as to be movable against an elastic bias force exerted by said flexible elastic part; and a holding member, as a part of said contact member, that protrudes into said space from one of said contact member sidewalls toward another of said contact member sidewalls, and that physically contacts said elastic part at a holding location between said U-shaped curved portion and said contacting part so as to restrain said elastic part in said elastically preloaded condition to prevent said elastic part from unflexing and relaxing out of said elastically preloaded condition;

wherein at least all of an extent of said flexible elastic part extending from said holding location to said U-shaped curved portion is completely and continuously received and enclosed in said space between said contact member sidewalls; and wherein said flexible elastic part has a width between said contact member sidewalls such that said flexible elastic part closely fits in said space between said contact member sidewalls so as to be laterally guided and constrained between and directly by said contact member sidewalls.

2. The electrical connector according to claim 1, wherein the first conductive part of the first article is an electrical wire, and said connecting part is a wire-crimping termination contact adapted to be crimped onto the wire.

3. The electrical connector according to claim 1, wherein the first conductive part of the first article is an electrical wire, and said connecting part comprises an insulation piercing contact.

4. The electrical connector according to claim 1, wherein said elastic part is a U-shaped cantilevered leaf spring with a first shank joining said connecting part, a second shank joining said contacting part, and a curved elastically flexed web that comprises said U-shaped curved portion interconnecting said first and second shanks, and wherein said holding member physically contacts an outer side of said second shank facing away from said first shank when said elastic part is in said elastically preloaded condition to restrain said second shank against moving away from said first shank while allowing said second shank to move toward said first shank.

5. The electrical connector according to claim 1, wherein said contact member is a single integral member of an electrically conductive material, integrally including said connecting part, said contacting part, said elastic part and said holding member.

6. The electrical connector according to claim 1, further comprising an electrically insulating housing with a cavity therein, wherein said contact member is received at least partially in said cavity of said housing, with said contacting part of said contact member being exposed from said housing.

7. The electrical connector according to claim 6, wherein said electrically insulating housing has plural housing outer sidewalls, with a fitting member provided on at least one of said housing outer sidewalls, wherein said fitting member is configured and adapted to fittingly engage the first article or the second article so as to mechanically connect said electrical connector to the first article or the second article.

8. The electrical connector according to claim 7, wherein said fitting member has therein a fitting groove, which is configured and adapted to fittingly receive therein a fitting protrusion of the first article or the second article.

9. The electrical connector according to claim 8, wherein said fitting groove includes a tapered groove mouth at at least one end of said fitting groove, wherein said tapered groove mouth widens toward said at least one end.

10. The electrical connector according to claim 8, wherein said fitting member has two flat planar faces that are oriented facing outwardly away from said housing and that border on said fitting groove therebetween.

11. The electrical connector according to claim 1, wherein all of said flexible elastic part that undergoes flexing between said contacting part and said U-shaped curved portion, as well as at least a majority of said U-shaped curved portion including all of a first one of two shanks of said U-shaped curved portion that is connected to said contacting part, are completely and continuously received and enclosed in said space between said contact member sidewalls.

12. The electrical connector according to claim 11, wherein only a non-flexing portion of said contact member comprising said contacting part protrudes out beyond said contact member sidewalls in a direction outwardly beyond said holding member so as to be exposed out of said space between said contact member sidewalls.

13. The electrical connector according to claim 11, further comprising an electrically insulating housing with a cavity therein, wherein said contact member is received at least partially in said cavity of said housing, with said contacting part of said contact member being exposed from said housing.

14. An electrical connector for electrically connecting a first conductive part of a first article with a second conductive part of a second article, said electrical connector comprising an electrically conductive contact member that comprises:

a connecting part adapted to be mechanically and electrically connected to the first conductive part of the first article;

a contacting part adapted to electrically contact the second conductive part of the second article, wherein said contacting part forms one end portion of said contact member and includes a terminating free end of said end portion of said contact member, and wherein said end portion adjoining and extending to said terminating free end is free, unrestrained and untouched by any other part of said connector over an entire range of normal flexing of said contact member;

a flexible elastic part that extends between and interconnects said connecting part and said contacting part and includes a U-shaped curved portion between said connecting part and said contacting part, and that is elastically flexed into an elastically preloaded condition and is further elastically deflectable when said contacting part is pressed, so that said contacting part is movably supported by said flexible elastic part so as to be movable against an elastic bias force exerted by said flexible elastic part; and a holding member, as a part of said contact member, that physically contacts said elastic part at a holding location between said U-shaped curved portion and said contacting part so as to restrain said elastic part in said elastically preloaded condition to prevent said elastic part from unflexing and relaxing out of said elastically preloaded condition.

15. The electrical connector according to claim 14, further comprising an electrically insulating housing with a cavity therein, wherein said contact member is received at least partially in said cavity of said housing, with said contacting part of said contact member being exposed from said housing.

16. The electrical connector according to claim 14, wherein said contacting part comprises an acute angle bend of said contact member forming a contact point that is adapted to electrically contact the second conductive part of the second article, wherein said contact point further comprises a dimple deformation in a direction transverse relative to said acute angle bend, and wherein said dimple deformation inherently stiffens said acute angle bend.

17. The electrical connector according to claim 16, further comprising an electrically insulating housing with a cavity therein, wherein said contact member is received at least partially in said cavity of said housing, with said contacting part of said contact member being exposed from said housing, and said contact point protruding outwardly out of said housing.

18. An electrical connector for electrically connecting a first conductive part of a first article with a second conductive part of a second article, said electrical connector comprising an electrically conductive contact member that comprises:

a connecting part adapted to be mechanically and electrically connected to the first conductive part of the first article;

two separate contacting parts adapted to electrically contact the second conductive part of the second article;

a flexible elastic part that extends between and interconnects said connecting part and said two separate contacting parts and includes a U-shaped curved portion between said connecting part and said contacting parts, and that is elastically flexed into an elastically preloaded condition and is further elastically deflectable when said two separate contacting parts are respectively pressed, so that said two separate contacting parts are separately and independently movably supported by said flexible elastic part so as to be movable against an elastic bias force exerted by said flexible elastic part; and a holding member, as a part of said contact member, that physically contacts said elastic part at a location between said U-shaped curved portion and said two separate contacting parts so as to restrain said elastic part in said elastically preloaded condition to prevent said elastic part from unflexing and relaxing out of said elastically preloaded condition:

wherein said elastic cart is a U-shaped cantilevered leaf spring with a first shank joining said connecting part, two separate second shanks respectively separately joining said two separate contacting parts, and a single curved elastically flexed web forming said U-shaped curved portion interconnecting said first shank respectively with said two separate second shanks.

19. The electrical connector according to claim 18, wherein the first conductive part of the first article is an electrical wire, and wherein said connecting part of said contact member comprises a crimp termination contact or an insulation piercing contact.

20. The electrical connector according to claim 18, further comprising an electrically insulating housing with a cavity therein, wherein said contact member is received at least partially in said cavity of said housing, with said contacting parts of said contact member being exposed from said housing.

21. The electrical connector according to claim 20, wherein said housing has plural housing outer sidewalls, with a fitting member provided on at least one of said housing outer sidewalls, wherein said fitting member is configured and adapted to fittingly engage the first article or the second article so as to mechanically connect said electrical connector to the first article or the second article.

22. A combination for establishing an electrical and mechanical interconnection, comprising:

a first article including a first article casing and a first conductive part;

a second article including a second article casing and a second conductive part; and an electrical connector including an electrically insulating housing with a cavity therein, an electrically conductive contact member that is received at least partially in said cavity of said housing, and a connector-side mechanical fixing structure provided on said housing;

wherein said contact member includes: a connecting part that is permanently mechanically and electrically connected to said first conductive part of said first article; a contacting part that is exposed from said housing and pressed against and electrically contacted with said second conductive part of said second article; a flexible elastic part that extends between and interconnects said connecting part and said contacting part, and that is elastically flexed into an elastically preloaded condition and is further elastically deflectable when said contacting part is pressed so as to movably support said contacting part and elastically bias said contacting part with an elastic bias force into contact with said second conductive part of said second article; and a holding member, as a part of said contact member, that physically contacts at least one of said elastic part and said contacting part so as to restrain said elastic part in said elastically preloaded condition to prevent said elastic part from unflexing and relaxing out of said elastically preloaded condition;

wherein one of said first article casing and said second article casing has a first recess in said casing, said housing of said electrical connector is at least partially fitted into and received in said first recess, and said connector-side mechanical fixing structure mechanically engages with a portion of said one of said first article casing and said second article casing and thereby mechanically fixes said electrical connector thereto; and wherein said first conductive part of said first article is a wire, and said second conductive part of said second article is a circuit board contact pad.

23. The combination according to claim 22, wherein said portion of said one of said first article casing and said second article casing comprises a sidewall of said first recess, said connector-side mechanical fixing structure comprises at least one elastically deflectable wing protruding laterally from said housing, and said elastically deflectable wing is elastically deflected and elastically urged to press and engage against said sidewall when said electrical connector is at least partially fitted into and received in said first recess.

24. The combination according to claim 22, wherein said housing of said electrical connector is press-fitted and frictionally engaged into said first recess.

25. The combination according to claim 22, wherein another of said first article casing and said second article casing not having said first recess has a second recess therein, and said housing of said electrical connector is at least partially fitted into and received in said second recess.

26. The combination according to claim 22, wherein said first article casing is said one of said casings that has said first recess therein.

27. The combination according to claim 22, wherein said second article casing is said one of said casings that has said first recess therein.

28. The combination according to claim 22, wherein said portion of said one of said first article casing and said second article casing comprises a casing-side mechanical fixing structure in said recess, and said connector-side mechanical fixing structure is mechanically engaged with said casing-side mechanical fixing structure.

29. The combination according to claim 28, wherein said connector-side mechanical fixing structure comprises a fitting groove, said casing-side mechanical fixing structure comprises a protrusion on a sidewall of said first recess, and said protrusion fittingly engages into said fitting groove when said electrical connector is at least partially fitted into and received in said first recess.

30. The combination according to claim 28, wherein said connector-side mechanical fixing structure comprises a locking pawl protruding from said housing, said casing-side mechanical fixing structure comprises a catch rim, and said locking pawl engages onto said catch rim when said electrical connector is at least partially fitted into and received in said first recess.

31. An electrical connector for electrically connecting a first conductive part of a first article with a second conductive part of a second article, said electrical connector comprising:

an electrically insulating housing with a cavity therein; and an electrically conductive contact member that is received at least partially in said cavity of said housing and that comprises:

a connecting part adapted to be mechanically and electrically connected to the first conductive part of the first article;

a contacting part exposed from said housing and adapted to electrically contact the second conductive part of the second article;

a flexible elastic part that extends between and interconnects said connecting part and said contacting part, and that is elastically flexed into an elastically preloaded condition and is further elastically deflactable when said contacting part is pressed, so that said contacting part is movably supported by said flexible elastic part so as to be movable against an elastic bias force exerted by said flexible elastic part; and a holding member, as a part of said contact member, that physically contacts at least one of said elastic part and said contacting part so as to restrain said elastic part in said elastically preloaded condition to prevent said elastic part from unflexing and relaxing out of said elastically preloaded condition;

wherein said housing includes a housing wall portion that physically contacts and supports said holding member.

32. The electrical connector according to claim 31, wherein said housing wall portion physically contacts and covers said holding member on a side thereof opposite said contact member.

33. The electrical connector according to claim 31, wherein an inner surface of said housing wall portion bounding said cavity is recessed to accommodate said holding member.

34. The electrical connector according to claim 31, wherein said housing wall portion contacting and supporting said holding member prevents said contacting part from moving in a lateral direction defining a width of said contact member.

* * * * *

UNITED STATES PATENT AND TRADEMARK OFFICE

CERTIFICATE OF CORRECTION

PATENT NO. : 7,153,173 B2
APPLICATION NO. : 10/445182
DATED : December 26, 2006
INVENTOR(S) : Harasawa et al.

It is certified that error appears in the above-identified patent and that said Letters Patent is hereby corrected as shown below:

Title page,
Item [56], References Cited, Other Publications
Line 2, after "Appl. No." replace " 10/017,98." by --10/017,983--;
Line 5, after "10/017,977" replace " ," by --;--;

Column 17,
Line 5, after "condition", replace " :" by --;--;
Line 6, after "elastic" replace " cart" by --part--.

Signed and Sealed this

Nineteenth Day of June, 2007

JON W. DUDAS
*Director of the United States Patent and Trademark Office*